United States Patent [19]

Groff

[11] 4,346,374

[45] Aug. 24, 1982

[54] CLASSROOM NOISE ALARM

[76] Inventor: James W. Groff, P.O. Box 38, Morgan Hill, Calif. 95037

[21] Appl. No.: 222,304

[22] Filed: Jan. 5, 1981

[51] Int. Cl.[3] ..... G08B 21/00

[52] U.S. Cl. ..... 340/573; 179/1 N; 307/117; 340/540

[58] Field of Search ..... 340/566, 573, 540, 501, 340/527; 179/1 N; 307/117; 181/0.5

[56] References Cited

U.S. PATENT DOCUMENTS

| | | | |
|---|---|---|---|
| 2,590,460 | 3/1952 | Rackey et al. | 340/566 |
| 2,969,530 | 1/1961 | Duncan | 340/566 |
| 3,158,850 | 11/1964 | Poznanski | 340/566 |
| 3,304,368 | 2/1967 | Ford et al. | 179/1 N |
| 4,099,168 | 7/1978 | Kedjierski et al. | 340/566 |

*Primary Examiner*—Glen R. Swann, III

[57] ABSTRACT

A noise alarm for use in a school classroom to detect sound exceeding a predetermined level and which actuates a two-tone audio alarm and a light-emitting diode to notify both the instructor and students when excessive noise has been detected. The noise alarm aids the instructor in preventing excessive classroom noise which can and does disrupt and destroy a given learning situation. A sensitivity control is provided to allow the instructor to determine the noise level at which the alarm will automatically respond, and time delay means are provided so the audio alarm will not sound unless excessive noise occurs twice and within a predetermined time frame. The noise alarm also provides a digital LED readout displaying how many times the audio alarm has been triggered, thus providing the instructor with a temporary record which can be used to reinforce acceptable classroom noise levels. Other controls are also provided, allowing the instructor to "erase" the count displayed or to place the noise alarm in a "hold" mode so that the alarm is temporarily disabled without disturbing any count which is currently displayed by the LED readout.

4 Claims, 5 Drawing Figures

CLASSROOM NOISE ALARM

BACKGROUND OF THE INVENTION

The present invention relates to the field of audio detectors and audio alarms, and is more particularly directed to a noise alarm used in a classroom to detect and react to noise exceeding a predetermined level.

A typical audio alarm device consists of a microphone, amplifier, sound switch, and associated sounding means which can range from a piezoelectric buzzer to a horn or siren. Sound alarms are often used in the home, office, factory, or automobile to detect intrusion or burglary, whereby the device detects and recognizes "break-in" sounds which differ in frequency or intensity from normal, ambient noise. To prevent false triggering, many sound alarm devices incorporate audio filters, time delay circuits, and sound cancellation circuits.

Although most learning institutions are concerned about burglary, a sound alarm can be used during normal teaching hours for an entirely different purpose; discipline. During the course of an average classroom day, the instructor finds that he or she must spend much time gently or forcefully reminding the students to be quiet so that the learning situation can continue. Too often the teacher must repeat the shopworn phrase, "You're too noisy!" even when the class is highly motivated and well-behaved, since the combined whispers and comments of thirty or so exuberant youngsters can quickly build to an earsplitting crescendo. Most instructors know they must demand a very fine line of discipline between normal, spontaneous vocal reaction to a given learning situation and uncontrolled cacophony which can quickly destroy the learning situation for the classroom involved, as well as adjoining classrooms. And, too often, this uncontrolled cacophony can erupt if the teacher must temporarily leave the classroom.

Thus, it is important for the instructor to consistently define for his students a certain level of noise which will be tolerated within his classroom. The students soon learn what the toleration level is and will conform to this level if they are consistently penalized when the noise level is broken. Here the task of establishing and maintaining an acceptable noise level can be consistently, automatically, and objectively accomplished by an electronic noise alarm. The alarm will continue to maintain a given acceptable noise level, even if the instructor must momentarily leave the classroom. Best of all, the teacher will rarely find it necessary to personally admonish his students with, "You're too noisy!" thus being able to devote all of his energy to the paramount task of teaching. It is, therefore, a general object of the present invention to provide a noise alarm which is used in a classroom to detect and react to noise exceeding a predetermined level, so the learning situations of the classroom and adjoining classrooms are not destroyed.

SUMMARY OF THE INVENTION

Accordingly, the primary object of the present invention is to provide a simple, inexpensive electronic audio alarm which detects noise and which actuates sounding means when classroom noise exceeds a predetermined level, thereby automatically notifying students they have exceeded an "acceptable" classroom noise level, as determined by their instructor. A further object of the present invention is to provide a noise alarm which can easily be adjusted for sensitivity by the instructor, thus allowing rapid and accurate setting of any desired noise trigger level. Another object of the present invention is to provide counting and readout means, whereby, each time the alarm is triggered, a count is registered and displayed on the face of the device, allowing both instructor and students to continuously monitor how many times classroom noise has exceeded an acceptable level. A further object of the present invention is to provide a noise alarm which provides "reset" means, allowing the instructor to instantly reset the counters to zero, thereby eliminating a previous count of how many times the alarm has been triggered. Yet another object of the present invention is to provide a noise alarm which provides "hold" means, allowing the instructor to disable the device during an anticipated noisy classroom interval without destroying any existing count which is displayed on the face of the device. Still another object of the present invention is to provide a noise alarm which incorporates time delay means, thereby preventing triggering of the sounding means unless excessive noise occurs within a predetermined time frame. A further object of the present invention is to provide a noise alarm which includes "monitor" means, allowing visual determination of when the detected noise is of sufficient intensity to trigger the device, as well as when the audible alarm is energized. An additional object of the present invention is to provide a noise alarm which is compact and which requires no changing of batteries. Still another object of the present invention is to provide a noise alarm incorporating automatic power-on reset, thus assuring the counters begin counting from zero when the device is turned on. Additional advantages and features of the present invention will be apparent from the following description of the preferred embodiment of the invention.

A preferred embodiment of the present invention provides a compact, AC-powered noise alarm which can be used at any location within a school classroom. Once the device is plugged in and turned on, the instructor sets a desired noise trigger level by turning an indexed potentiometer knob and observing a "monitor" light-emitting diode (LED) which glows when noise entering the device through a small microphone contained in the front panel of the device is of sufficient intensity to trigger sounding means of the alarm. Time delay circuits within the device allow the alarm circuit to be enabled by the first noise which exceeds a predetermined trigger level, but do not allow associated sounding means to be actuated unless additional excessive noise occurs after 14 seconds, but not later than 19 seconds, following the initial noise. When triggered, sounding means comprising a dual oscillator, amplifier, and speaker produce a 2.5-second two-tone alarm which notifies both instructor and students that excessive noise is being detected.

The noise alarm also provides a 2-digit LED readout which allows visual monitoring of exactly how many times (1 to 99) the alarm has been triggered. The LED readout can be reset at any time the instructor so desires, and the noise alarm can be disabled, while still retaining the count display. The noise alarm additionally contains automatic power-on reset means, assuring that internal counters are reset to zero following initial application of power to the device. By requiring that a certain number of counts, as displayed by the LED readout, will result in a given penality to the class, the instructor reinforces an acceptable classroom noise level which he has determined and which is automatically maintained by the noise alarm device.

DESCRIPTION OF THE PREFERRED EMBODIMENT

Figure 1:
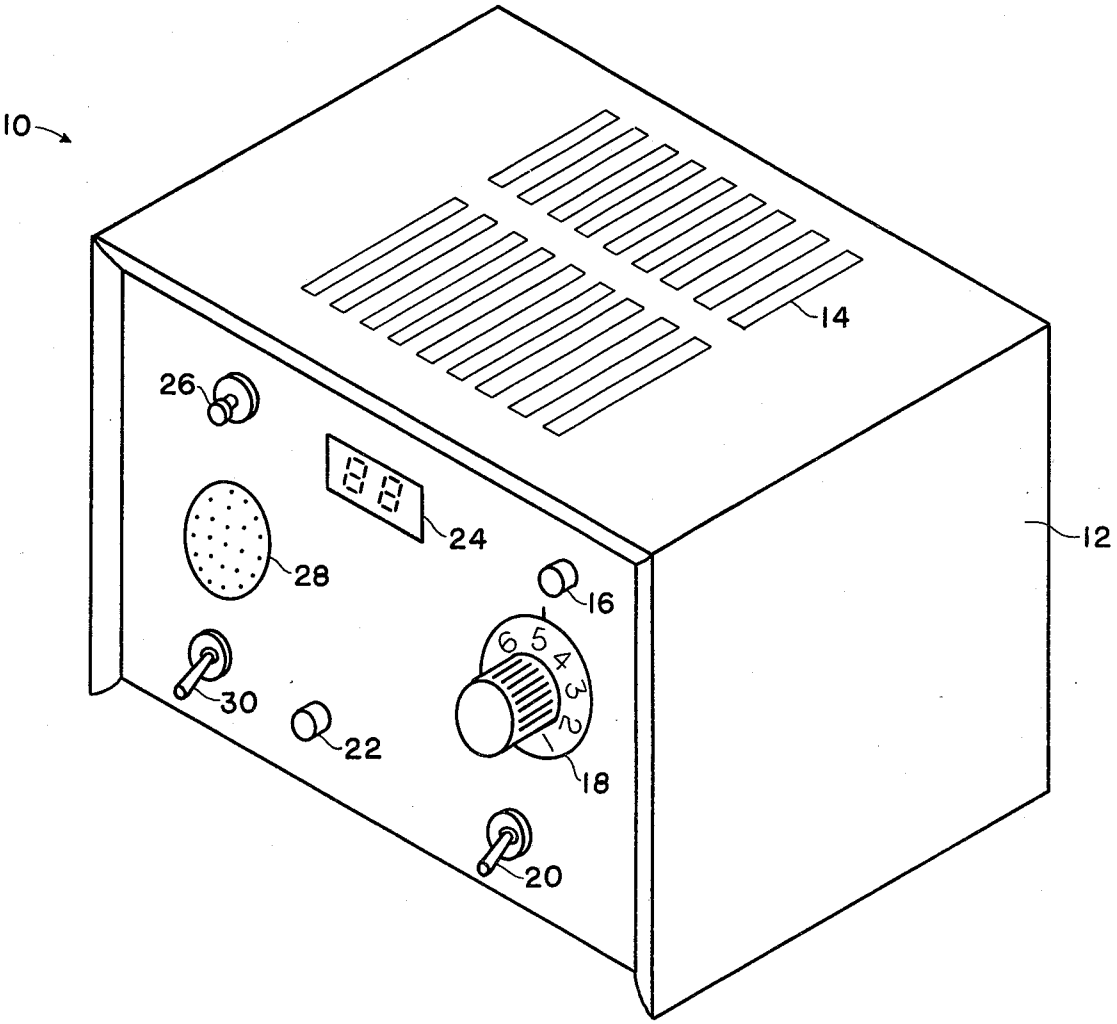
FIG. 1 is a perspective view of the classroom noise alarm of the present invention.

Referring to FIG. 1, a classroom noise alarm 10 is shown. The alarm is designed to detect and react to noise in excess of a predetermined level which occurs within a school classroom. The exterior of sound alarm 10 consists of a housing 12, a speaker grille 14, a "monitor" LED 16, a "level" potentiometer 18, a "hold" switch 20, a "hold indicator" LED 22, an LED readout 24, a "reset" push button switch 26, a microphone 28, and a power switch 30. A line cord (not shown) extends from the rear of the housing, allowing the noise alarm to be plugged into any convenient wall inlet. The device is powered when switch 30 is placed in the up position, but the alarm and LED readout 24 are disabled for several seconds while an internal power-on reset timer cycles. This prevents invalid alarms and counts due to glitches which occur during initial power-up.

Any classroom noise is detected by microphone 28, and will trigger the alarm if level potentiometer 18 is set at an appropriate position. If the noise is of sufficient intensity to trigger alarm circuitry, depending on the position of potentiometer 18, internal sounding means, including a speaker which is mounted beneath speaker grille 14, produce a loud, two-tone alarm for a period of 2.5 seconds. To aid in desired adjustment of potentiometer 18, monitor LED 16 is observed to note when the LED glows, since this indicates that noise entering the device is of sufficient intensity to trigger the alarm circuitry. Each time the alarm sounds, LED readout 24 displays a count, beginning with "1" and going as high as "99". The displayed count will, of course, be destroyed if the noise alarm is turned off by switch 30, but will retain any previous count if the alarm is put into a hold mode by placing hold switch 20 in an up position. The purpose of the hold control is to allow the instructor to temporarily disable the sound alarm while retaining any previous displayed count, if the instructor anticipates a particularly noisy classroom period which he does not wish to monitor with noise alarm 10. An associated hold indicator LED 22 is illuminated during the hold mode to remind the instructor that the sound alarm is disabled. If, on the other hand, the instructor wishes to erase the count displayed by LED readout 24, he can simply depress reset button 26. At this time internal counters are reset to zero, and the LED readout remains blank until the alarm is again triggered and a new count is recorded.

Figure 2:
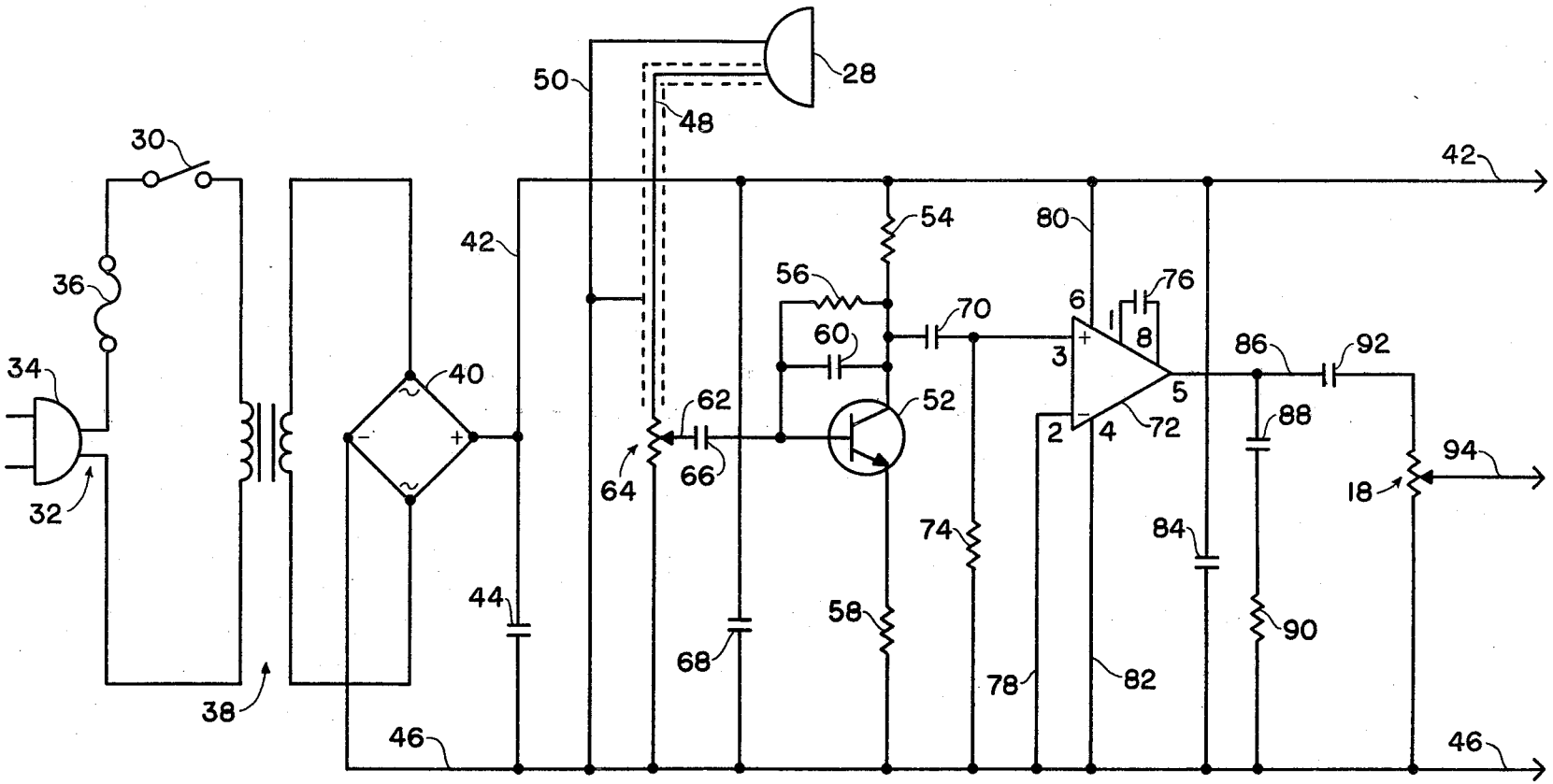
FIG. 2 is a schematic diagram of the power supply, microphone input, preamplifier, and amplifier of the present invention.

Referring next to FIG. 2, the power supply, microphone input, preamplifier, and amplifier of the classroom alarm 10 are shown in a schematic diagram. A line cord 32 and attached plug 34 allow the noise alarm to be connected to an AC power source. One side of line cord 32 is connected, via a $\frac{1}{4}$ ampere fast-blow fuse 36 and a SPST power switch 30, to one terminal of the primary winding of a 120/6.3 VAC step-down transformer 38. The other side of line cord 32 is connected to the remaining primary terminal of transformer 38. Both sides of the 6.3 VAC rms secondary winding are connected to appropriate AC terminals of a full-wave rectifier 40. The rectified DC current appearing on line 42 is at approximately 8.8 volts, and is filtered by a large electrolytic capacitor 44 which is connected between line 42 and rectifier ground which appears on line 46. Lines 42 and 46 provide VCC and ground, respectively, for the noise alarm.

A low impedance, omni-directional, dynamic microphone 28 is connected, via ground line 48, to the preamplifier circuit of the device. Shielded line 50 connects the microphone to ground. It should be noted that the microphone element must be positioned within housing 12 to afford maximum distance between the microphone and power transformer 38, so that 60-cycle hum will not be picked up and amplified. The gain of the preamplifier, which is comprised of an NPN transistor 52, resistors 54, 56, and 58, and capacitor 60, is determined by the position of wiper 62 of a potentiometer 64. A small capacitor 66 is used to couple the microphone input with the base of preamplifier transistor 52. An additional capacitor 68 is connected between supply lines 42 and 46 to decouple the preamplifier from these lines. A further capacitor 70 couples the preamplifier output to the non-inverting input of an LM-386 amplifier 72. Resistor 74 limits the input gain of the amplifier which, in turn, is set at 200 by a capacitor 76. The amplifier's inverting input is shorted to ground via line 78, while lines 80 and 82 supply VCC and ground to the IC. Amplifier 72 is decoupled from its supply lines by capacitor 84, and the amplified microphone output appears on line 86. To prevent unwanted RF oscillation, a capacitor 88 and resistor 90 form a series network from line 86 to ground. The amplified output appearing on line 86 is then coupled, via a capacitor 92, with the sound level input potentiometer 18. As previously discussed, potentiometer 18 is used to set the sensitivity of the sound-actuated switch (FIG. 3), and determines what intensity of noise is necessary in order to trigger the alarm circuits.

Since potentiometer 18 is used to determine all noise level settings, preamplifier input potentiometer 64 remains in a relatively high gain position, although it can be adjusted to require higher setting of potentiometer 18 for a given noise level, if this is desired. The control knob for potentiometer 18 is indexed from "0" to "10" and referenced with a line inscribed on the front housing panel, allowing the instructor to easily associate various classroom noise levels with whether or not the sound alarm is actuated. Once various noise levels are determined, the numbers on the knob provide a handy visual reference, allowing quite accurate noise level adjustment. The wiper 94 of potentiometer 18 is, in turn, connected to a sound-actuated switch which will be described with reference to FIG. 3.

Figure 3:
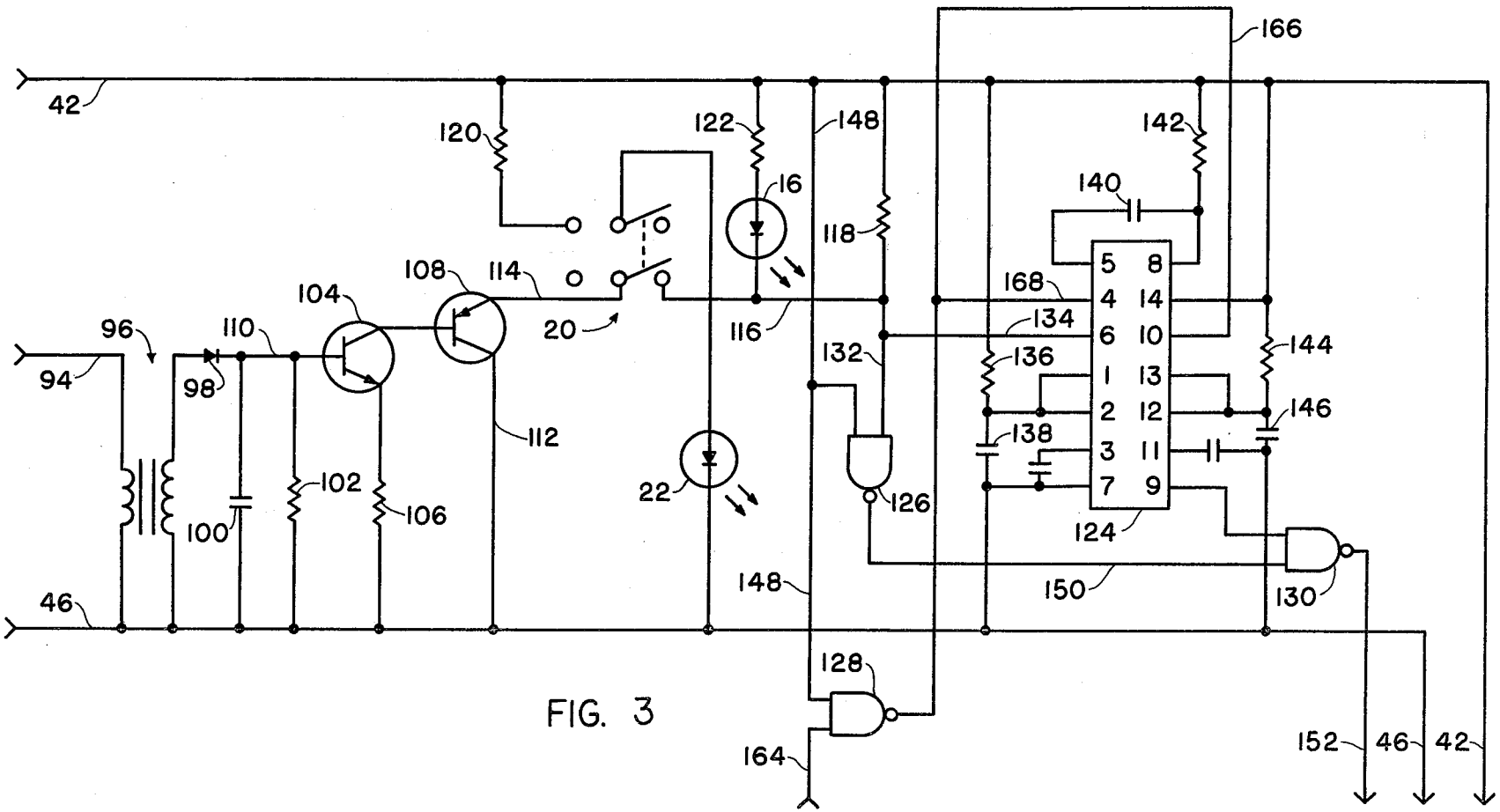
FIG. 3 is a schematic diagram of the sound-actuated switch and time delay circuits of the present invention.

Referring now to FIG. 3, of a sound-actuated switch and time delay circuits of the noise alarm are shown. To convert the amplified microphone output from analog to digital control signals, the noise alarm uses a sound-actuated switch which comprises an audio transformer 96, a diode 98, a capacitor 100, a resistor 102, an NPN transistor 104, a resistor 106, and a PNP transistor 108. A step-up audio transformer 96 is included in the circuit to slightly boost the AC voltage appearing on wiper line 94 as it is coupled to and appears at diode 98. The lower terminals of both the primary and secondary windings of transformer 96 are connected to system ground at line 46. Any AC voltage appearing at diode 98 is rectified by the diode and, in turn, filtered by capacitor 100, thus producing a positive digital voltage on line 110 in response to classroom noise which is detected by microphone 28 (FIG. 2). Line 110 is connected to the base of an NPN transistor 104, causing the transistor to conduct when sound is detected. A pull-down resistor 102 is connected between line 110 and ground to provide line 110 with a quiescent logical "0", thus preventing premature and false conduction of transistor 104. The emitter of transistor 104 is connected to ground via a current limiting resistor 106, while the collector is directly connected to the base of a PNP transistor 108. The collector of transistor 108 is connected, via line 112, to ground, thus providing a logical "0" output at its emitter and line 114 when sound is detected by microphone 28. As can be seen, transistor 104 inverts the rectified audio signal and transistor 108 further amplifies and switches it. Thus, any noise which is detected by microphone 28 and which is preamplified, amplified, and passed by level potentiometer 18 (FIG. 2) appears at line 114 as a logical "0" pulse.

At this point, the first terminals of a DPDT hold switch 20 control whether or not the sound-actuated switch output is conducted to associated time delay circuits. When hold switch 20 is closed, any logical "0" sound-actuated switch output appears on line 116. If the hold switch is open, line 116 remains at logical "1", since a pull-up resistor 118 is connected between line 116 and line 42 (VCC). To remind the instructor of the hold switch position, a hold switch indicator LED 22 is connected via the second terminals of DPDT hold switch 20. When the switch is open the LED glows, since it receives current via a current limiting resistor 120 and hold switch 20. An additional monitor LED 16 has its cathode connected to line 116 and its anode connected to VCC via a current limiting resistor 122. With this arrangement, any noise which is of sufficient intensity to cause the sound-actuated switch to output a logical "0" voltage will, in turn, cause monitor LED 16 to glow. When level potentiometer 18 is set at a high index number, monitor LED 16 glows in synchronous response to any noise occuring within the classroom. Thus, the instructor is aided in setting potentiometer 18 by observing LED 16 as the indexed potentiometer knob is turned. If the instructor desires the sound alarm to be actuated at any given noise level, he simply rotates the knob of potentiometer 18 until monitor LED 16 begins to glow. The reverse procedure is followed if the instructor does not wish to have the alarm activated at a given noise level. As previously mentioned, various noise levels can be quickly established and referenced by noting the position of the index numbers on the potentiometer knob.

The monitor LED 16 also provides a visual warning to students when their noise level is high enough to be detected by the alarm device, since the LED flashes in response to noise being detected. If the students immediately become quiet, the sounding means of the noise alarm will not be actuated. If, however, the students continue to make noise, the audible alarm sounds and monitor LED 16 glows steadily at full intensity for the duration of the alarm, since the sound-actuated switch output on line 116 is driven to a steady logical "0" level by the sound of the audible alarm.

The sound switch output which appears on line 116 is next processed and switched by several time delay circuits comprising a 556 dual timer 124 and three gates 126, 128, and 130 of a quad, 2-input 4011 NAND. Power supply leads and a bypass capacitor for the NAND gates are not shown. CMOS gates are chosen here because they can function between 3 and 15 volts. Since all components utilized can operate within this approximate voltage range, the classroom noise alarm 10 does not contain a voltage regulator. Sound-actuated switch output line 116 is connected, via lines 132 and 134, to the trigger (pin 6) of the first timer of dual timer 124. Since any sound-actuated switch output is negative, the timer is immediately triggered when an output occurs in response to detected noise. The monostable's timing resistor 136 and timing capacitor 138 are chosen to provide a 14-second logical "1" voltage following each triggering. The timer's output (pin 5) is conducted, via a capacitor 140, to the trigger (pin 8) of a second timer of dual timer 124. Capacitor 140, in association with a pull-up resistor 142, forms a negative edge detector which, in turn, triggers the second timer when the output of the first timer at pin 5 drops to logical "0" subsequent to the 14-second timing cycle. A timing resistor 144 and timing capacitor 146 are selected to produce a 5-second timing cycle for the second timer of dual timer 124. The timer output (pin 9) is connected to the second input of NAND gate 130.

In addition to being connected to the trigger (pin 6) of a first timer of dual timer 124, the sound-actuated switch output appearing on line 116 is also connected, via line 132, to the first input of NAND gate 126. The second NAND input is connected, via line 148, to VCC, allowing the gate to function as an inverter. The output of NAND gate 126 is conducted, via line 150, to the first input of NAND gate 130. With this arrangement, the first timer of dual timer 124 is immediately triggered by any sound-actuated switch output. The second timer of dual timer 124 is triggered only after the first timer completes its 14-second cycle, thus causing the second timer to be triggered 14 seconds following sound detection by classroom noise alarm 10. During its 5-second timing cycle, the second timer "enables" NAND gate 130 by holding the second input high. Any additional sound-actuated switch output appearing on line 116, which is inverted to logical "1" by NAND gate 126 and which is conducted, via line 150, to the first input of NAND gate 130, causes the output of gate 130 to drop to logical "0". In effect, gate 130 re-inverts the inverted signal from gate 126. In summary, NAND gate 130 is "enabled" for a five second period which occurs subsequent to a 14-second period following initial sound detection by the noise alarm. If additional noise of sufficient intensity is detected during the 5-second "enable" period, gate 130 drops to logical "0" in synchronous response to the noise detected.

Figure 4:
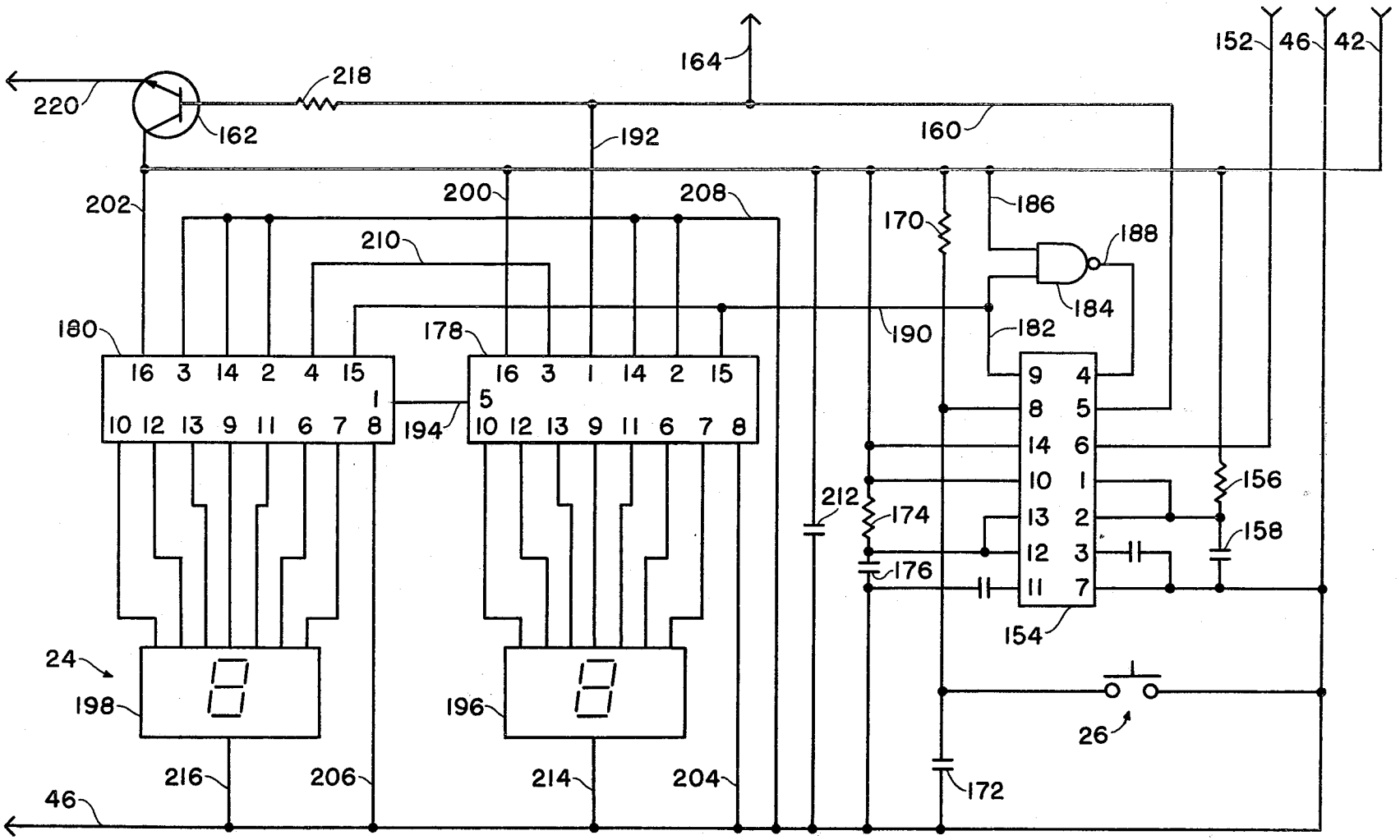
FIG. 4 is a schematic diagram of the sounding means timer, power-on reset means, counters, LED readout, and sounding means driver transistor of the present invention.

Referring next to FIG. 4, a sounding means timer, power-on reset means, counters, LED readout, and sounding means driver transistor are shown in a schematic diagram. The output of NAND gate 130 (FIG. 3) is conducted on line 152 to the trigger (pin 6) of a first timer of a 556 dual timer 154. This monostable is used to actuate the sound alarm's sounding means, and has a timing resistor 156 and a timing capacitor 158 which produce a 2.5-second RC timing cycle. The timer's output (pin 5) is conducted on line 160 to an NPN driver transistor 162 which controls the sounding means, and is conducted on line 164 to a first input of NAND gate 128 (FIG. 3). A second input of gate 128 is connected, via line 148, to VCC (line 42). Thus, NAND gate 128 is used as an inverter, and has its output connected, via line 166 and line 168, to the reset inputs (pins 4 and 10) of dual timer 124 (FIG. 3). This arrangement assures that sound from the alarm itself does not re-trigger timers of dual timer 124, since the reset inputs are held at logical "0" and the timers are, consequently, disabled during the 2.5-second alarm period.

A second timer of dual timer 154 functions as an automatic, power-on reset means. The trigger (pin 8) of this monostable is connected to a negative edge detector comprising a pull-up resistor 170 and a capacitor 172, causing the timer to be triggered each time power is initially applied to the sound alarm by turning on power switch 30 (FIG. 2). A timing resistor 174 and timing capacitor 176 provide a 20-second timing cycle which resets the first (alarm) timer of dual timer 154 and two counters 178 and 180. The timer output (pin 9) is conducted, via line 182, to a first input of a NAND gate 184. A second input of the gate is connected, via line 186, to VCC, again allowing the NAND gate to function as an inverter. The NAND output is conducted, via line 188, to the reset input (pin 4) of the 2.5-second alarm timer, causing the timer and associated alarm to be disabled during the 20-second power-on reset period. During this 20-second period, line 182 is high, while line 188 is low. With this arrangement, power-up glitches have no effect on the alarm timer or on the counters. Rather than provide an additional gate on line 190, so the counters can be manually reset by depressing reset push button switch 26, the normally-open switch is simply connected between ground (line 46) and the trigger (pin 8) of the power-on reset timer. Although the counters and alarm will be disabled for a 20-second period, this makes little difference in operation of classroom noise alarm 10, since detected classroom noise cannot trigger the alarm for a minimum of 14 seconds anyway.

To count the number of times the alarm is actuated, two 4033 decade counters 178 and 180 with internal 7-segment decoders are cascaded. Line 160 which conducts the output of the alarm timer is connected, via line 192, to the clock input of a first (units) decade counter 178. The divide-by-10 output (pin 5) of the counter is connected, via line 194, to the clock input (pin 1) of a second (tens) decade counter 180, thus allowing the cascaded counters to count from "1" to "99" and display the decoded count on two associated common cathode, 7-segment LED's 196 and 198. LED's 196 and 198 comprise LED readout 24, as shown in FIG. 1.

The counters receive VCC via lines 42, 200, and 202. Ground is supplied via lines 46, 204, and 206. Clock enable and test inputs (pins 2 and 14) are held low via lines 46 and 208. Line 182 which conducts the output from the power-on reset timer of dual timer 154 is connected, via line 190, to counter reset inputs (pins 15), causing the counters to be reset to zero following turn-on of classroom noise alarm 10 by power switch 30 (FIG. 2) and depression of reset push button switch 26. To extinguish redundant zero displays, such as "00," "01," "02," etc. zero blanking inputs and outputs of the counters are utilized. The ripple blanking input (pin 3) of counter 198 is held low via lines 208 and 46, and the ripple blanking output (pin 4) is connected, via line 210, to the RB input (pin 3) of counter 178. A small capacitor 212 is connected between line 42 (VCC) and line 46 (ground) to bypass the counters.

Since the counters contain internal decoder/driver outputs, input terminals of LED's 196 and 198 are directly connected to the counters. Because the CMOS counters provide current limiting output stages, no current limiting resistors are needed between driver outputs and LED inputs. The LED's are grounded via line 46 and lines 214 and 216, and provide a two-digit readout which displays the total number of times the sounding means of the noise alarm are actuated. Since a logical "1" voltage on line 160 actuates the alarm sounding means, and, since the counter clock inputs are positive edge responding, LED readout 24 (FIG. 1) is immediately updated each time the sounding means are actuated. Line 160 which conducts the output of the alarm timer of dual timer 154 is connected, via a bias resistor 218, to the base of an NPN driver transistor 162. The transistor's collector is connected to VCC via lines 42 and 202, providing VCC at its emitter output and line 220 for 2.5 seconds each time the alarm timer is triggered.

Figure 5:
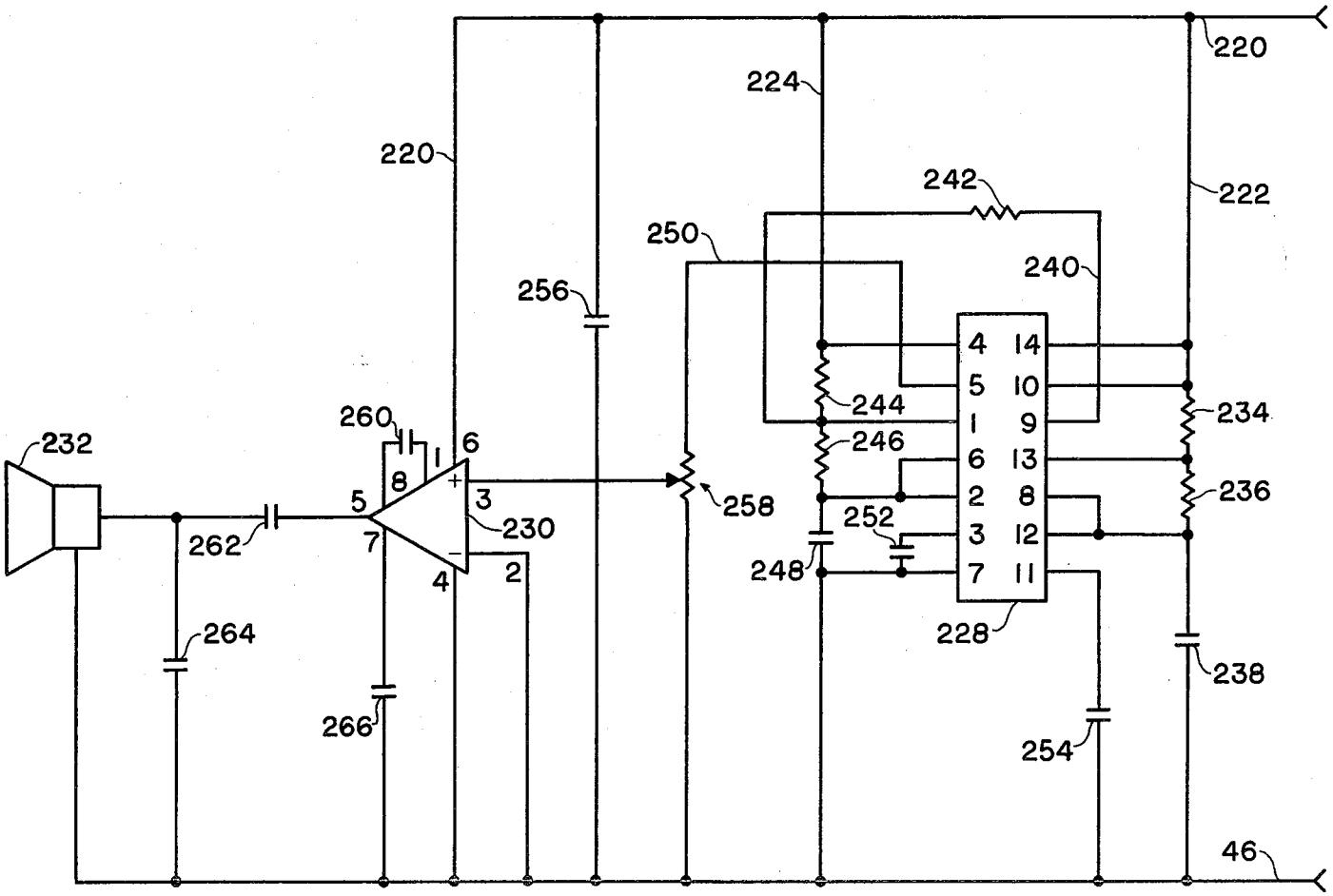
FIG. 5 is a schematic diagram of the sounding means oscillators, amplifier, and speaker of the present invention.

Referring next to FIG. 5, the alarm sounding means comprising a dual 556 timer (used as a dual oscillator), an LM-386 amplifier, and speaker are shown. Lines 220, 222, and 224 provide timed VCC to a 556 dual timer 228 and an LM-386 low-power amplifier 230. Both components are grounded via line 46. Dual timer 228 is utilized in the astable (oscillator) mode to provide a two-tone audio alarm which, in turn, is amplified by amplifier 230 and reproduced by speaker 232. The speaker is affixed to the inside top surface of the noise alarm housing 12 and below speaker grille 14 (FIG. 1). A first astable multivibrator of dual timer 228 contains timing resistors 234 and 236, and a timing capacitor 238. Charging time of capacitor 238 is determined by the values of both resistors in series with the capacitor. Discharging time is determined by resistor 236 and the capacitor. The resistors and associated capacitor are chosen to provide a 4-Hz frequency which, in turn, is conducted from the astable output (pin 9) through line 240 and resistor 242 to timing resistors of a second astable multivibrator of dual timer 228. Timing registors 244 and 246 and timing capacitor 248 of the second astable are selected to provide a nominal 1-kHz frequency. Since resistor 242 works in parallel with timing resistor 244, the 1-kHz frequency is modified eight times a second as the 4-Hz astable cycles from logical "0" to logical "1" and back again. The resulting square-wave output appears on line 250, and produces a distinct two-note tone. As with dual timers 124 and 154 (FIGS. 3 and 4), the control voltage inputs (pins 3 and 11) are bypassed to ground via capacitors 252 and 254. An additional capacitor 256 is connected between line 220 (VCC) and line 46 (ground) to decouple amplifier 230.

The astable output on line 250 is connected to ground via a resistive element of a voltage divider 258, with the wiper terminal connected to the non-inverting input of amplifier 230. As in amplifier 72 (FIG. 2), the inverting input is shorted to ground, and the amplifier gain set to 200 by a capacitor 260. A capacitor 262 couples the amplifier output with speaker 232, and two small bypass capacitors 264 and 266 stabilize the amplifier output. When the alarm timer of dual timer 154 (FIG. 4) is triggered, a 2.5-second logical "1" pulse is conducted via line 160, causing driver transistor 162 to conduct, and, in turn, provide the astables and amplifier with 2.5 seconds of current on lines 220, 222, and 224. Thus, a two-tone alarm is clearly heard when classroom noise alarm 10 detects excessive noise which occurs within the previously described 5-second time frame. Voltage divider 258 is adjusted to provide optimal volume for the alarm.

Although the present invention utilizes a two-tone speaker-oscillator type of sounding means, any of several means, such as a piezoelectric buzzer, electromechanical bell or chimes can be used. The alarm must be such that it can easily be heard within the classroom, but not loud enough to disturb adjoining classrooms. Although the present invention utilizes 14-second and 5-second time delay circuits, other time delays can, of course, be used. The rationale for the above time delays is quite simple. By not allowing the alarm to be actuated unless excessive classroom noise persists beyond a 14-second period, the instructor will have time to vociferously admonish a student or entire class for causing the initial noise without triggering the alarm himself. Also, the alarm is tolerant of occasional loud sound, as long as repeated excessive noise does not occur within a 5-second time frame from 14 to 19 seconds following initial detection of excessive noise.

One distinct advantage of the noise alarm is that it can be used to control student noise when the instructor is not physically present in the classroom. Many teachers will want to translate the count displayed by the LED readout into one minute for each count, i.e., the students will be penalized one minute of recess time, P.E. time, dismissal time, etc. for each count displayed. Although most early grade students will respect the noise alarm and its purpose if the teacher is fair and consistent in its application, some upper grade students may attempt to tamper with the alarm when the teacher temporarily leaves the classroom. Since any one of several controls on the noise alarm can defeat the alarm or destroy the count, a hinged panel can be provided on the front surface of the alarm housing so the panel can be closed and locked, if the instructor wishes. Since the noise alarm is disabled and the count destroyed when the electrical plug is pulled, internal batteries can be provided to maintain power when the AC source is disrupted. The power supply circuit can include five nickel cadmium cells which are trickle-charged when the noise alarm receives AC current and which provide full power to the device, if the AC source is unplugged. By using a DPDT power switch, both AC and battery modes remain simultaneously switchable.

The terms and expressions which have been employed in the foregoing drawings, abstract, and specification are used therein as terms of description and not of limitation; it being understood that changes may be made in the embodiment disclosed without departing from the spirit and scope of the invention as defined in the following claims.

What is claimed is:

1. A classroom noise alarm for aiding the teacher in maintaining discipline comprising in combination: a power supply circuit for energizing said classroom noise alarm; a switch for actuating said power supply circuit of said classroom noise alarm; audible alarm means; a microphone for detecting noise occuring within a school classroom; an audio amplifier coupled with said microphone for amplifying the output thereof; adjustable resistance means coupled to the output of said audio amplifier for controlling the amplitude of an amplified noise signal; a sound-actuated switch coupled to the output of said adjustable resistance means and comprising an operatively associated audio input transformer, rectifieto the trigger of said second monostable multivibrator, the output thereof being connected to a second input terminal of said logic gate, thereby preventing said logic control signal of said sound-actuated switch from being conducted through said logic gate except during a predetermined time delay of said second monostable multivibrator occuring subsequent to a prior, predetermined time delay of said first monostable multivibrator for initiating actuation of said audible alarm means only after repeated classroom noise occuring within a specified timed interval; a second timing means, the trigger thereof being connected to the output of said logic gate of said first timing and control logic means and the output being connected to said audible alarm means for controlling actuation and duration of said audible alarm means; and counting and readout means operatively associated with said second timing means for counting and displaying the exact number of times said audible alarm means are actuated by classroom noise.

2. A classroom noise alarm for aiding the teacher in maintaining discipline comprising in combination: a power supply circuit for energizing said classroom noise alarm; a switch for actuating said power supply circuit of said classroom noise alarm; audible alarm means; a microphone for detecting noise occuring within a school classroom; an audio amplifier coupled with said microphone for amplifying the output thereof; adjustable resistance means coupled to the output of said audio amplifier for controlling the amplitude of an amplified noise signal; a sound-actuated switch coupled to the output of said adjustable resistance means and comprising an operatively associated audio input transformer, rectifier diode, filter capacitor, amplifier transistor, and switching transistor for providing a logic control signal in response to the output of said audio amplifier when classroom noise exceeds a predetermined level as determined by said adjustable resistance means; holding means comprising a DPDT switch connected to the output of said sound-actuated switch, the first terminals of said DPDT switch conducting said logic control signal of said sound-actuated switch when said DPDT switch is in a first, non-hold position and the second terminals energizing a light-emitting diode hold indicator when said DPDT switch is in a second, hold position for disabling said classroom noise alarm without disrupting power thereto and for indicating a hold condition to students and instructor; a first timing and control logic means comprising a first and second monostable multivibrator, edge detector, and logic gate, the trigger of said first monostable multivibrator and a first input terminal of said logic gate being operatively connected to the output of said sound-actuated switch when said DPDT switch is in a said non-hold position, the output of said first monostable multivibrator being connected in series with said edge detector to the trigger of said second monostable multivibrator, the output thereof being connected to a second input terminal of said logic gate, thereby preventing said logic control signal of said sound-actuated switch from being conducted through said logic gate except during a predetermined time delay of said second monostable multivibrator occuring subsequent to a prior, predetermined time delay of said first monostable multivibrator for initiating actuation of said audible alarm means only after repeated classroom noise occuring within a specified timed interval; a second timing means, the trigger thereof being connected to the output of said logic gate of said first timing and control logic means and the output being connected to said audible alarm means for controlling actuation and duration of said audible alarm means; and counting and readout means operatively associated with said second timing means for counting and displaying the exact number of times said audible alarm means are actuated by classroom noise.

3. A classroom noise alarm for aiding the teacher in maintaining discipline comprising in combination: a power supply circuit for energizing said classroom noise alarm; a switch for actuating said power supply circuit of said classroom noise alarm; audible alarm means; a microphone for detecting noise occuring within a school classroom; an audio amplifier coupled with said microphone for amplifying the output thereof; adjustable resistance means coupled to the output of said audio amplifier for controlling the amplitude of an amplified noise signal; a sound-actuated switch coupled to the output of said adjustable resistance means and comprising an operatively associated audio input transformer, rectifier diode, filter capacitor, amplifier transistor, and switching transistor for providing a logic control signal in response to the output of said audio amplifier when classroom noise exceeds a predetermined level as determined by said adjustable resistance means; a first timing and control logic means comprising a first and second monostable multivibrator, edge detector, and logic gate, the trigger of said first monostable multivibrator and a first input terminal of said logic gate being connected to the output of said sound-actuated switch, the output of said first monostable multivibrator being connected in series with said edge detector to the trigger of said second monostable multivibrator, the output thereof being connected to a second input terminal of said logic gate, thereby preventing said logic control signal of said sound-actuated switch from being conducted through said logic gate except during a predetermined time delay of said second monostable multivibrator occuring subsequent to a prior, predetermined time delay of said first monostable multivibrator for initiating actuation of said audible alarm means only after repeated classroom noise occuring within a specified timed interval; a second timing means, the trigger thereof being connected to the output of said logic gate of said first timing and control logic means and the output being connected to said audible alarm means for controlling actuation and duration of said audible alarm means; and counting and readout means operatively associated with said second timing means for counting and displaying the exact number of times said audible alarm means are actuated by classroom noise, said counting and readout means further comprising a reset switch in series with reset means for resetting said counting and readout means to zero when the instructor so desires.

4. A classroom noise alarm for aiding the teacher in maintaining discipline comprising in combination: a power supply circuit for energizing said classroom noise alarm; a switch for actuating said power supply circuit of said classroom noise alarm; audible alarm means; a microphone for detecting noise occuring within a school classroom; an audio amplifier coupled with said microphone for amplifying the output thereof; adjustable resistance means coupled to the output of said audio amplifier for controlling the amplitude of an amplified noise signal; a sound-actuated switch coupled to the output of said adjustable resistance means and comprising an operatively associated audio input transformer, rectifier diode, filter capacitor, amplifier transistor, and switching transistor for providing a logic control signal in response to the output of said audio amplifier when classroom noise exceeds a predetermined level as determined by said adjustable resistance means; a noise monitor and alarm indicating means comprising a light-emitting diode connected to the output of said sound-actuated switch, said light-emitting diode being illuminated in synchronization with the output of said sound-actuated switch for visual indication of when classroom noise is of sufficient intensity to actuate said classroom noise alarm and for visual indication of when said audible alarm means are actuated; a first timing and control logic means comprising a first and second monostable multivibrator, edge detector, and logic gate, the trigger of said first monostable multivibrator and a first input terminal of said logic gate being connected to the output of said sound-actuated switch, the output of said first monostable multivibrator being connected in series with said edge detector to the trigger of said second monostable multivibrator, the output thereof being connected to a second input terminal of said logic gate, thereby preventing said logic control signal of said sound-actuated switch from being conducted through said logic gate except during a predetermined time delay of said second monostable multivibrator occuring subsequent to a prior, predetermined time delay of said first monostable multivibrator for initiating actuation of said audible alarm means only after repeated classroom noise occuring within a specified timed interval; a second timing means, the trigger thereof being connected to the output of said logic gate of said first timing and control logic means and the output being connected to said audible alarm means for controlling actuation and duration of said audible alarm means; and counting and readout means operatively associated with said second timing means for counting and displaying the exact number of times said audible alarm means are actuated by classroom noise.

* * * * *

UNITED STATES PATENT AND TRADEMARK OFFICE

CERTIFICATE OF CORRECTION

PATENT NO. : 4,346,374

DATED : August 24, 1982

INVENTOR(S) : James W. Groff

It is certified that error appears in the above—identified patent and that said Letters Patent is hereby corrected as shown below:

Column 1, line 21, ";" should read -- : --.

Column 4, line 21, "Shielded" should read -- Ground --.

Column 8, line 2, "198" should read -- 180 --.

Column 10, line 6, "rectifierto" should read -- recetifier --.

Column 10, line 6, after "rectifier" should read -- diode, filter capacitor, amplifier transistor, and switching transistor for providing a logic control signal in response to the output of said audio amplifier when classroom noise exceeds a predetermined level as determined by said adjustable resistance means; a first timing and control logic means comprising a first and second monostable multivibrator, edge detector, and logic gate, the trigger of said first monstable multivbrator and a first input terminal of said logic gate being connected to the output of said sound-actuated switch, the output of said first monstable multivibrator being connected in series with said edge detector --.

Signed and Sealed this

*Second* Day of *November 1982*

[SEAL]

*Attest:*

GERALD J. MOSSINGHOFF

*Attesting Officer*

*Commissioner of Patents and Trademarks*